US008054005B2

(12) United States Patent
Tonomura

(10) Patent No.: US 8,054,005 B2
(45) Date of Patent: Nov. 8, 2011

(54) DRIVING CIRCUIT FOR DISPLAY DEVICE, AND TEST CIRCUIT AND TEST METHOD FOR DRIVING CIRCUITS

(75) Inventor: Fumio Tonomura, Shiga (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 366 days.

(21) Appl. No.: 12/382,831

(22) Filed: Mar. 24, 2009

(65) Prior Publication Data

US 2009/0256493 A1 Oct. 15, 2009

(30) Foreign Application Priority Data

Apr. 4, 2008 (JP) ..... 2008-098783

(51) Int. Cl.
*G05F 1/00* (2006.01)

(52) U.S. Cl. ..... 315/291; 315/169.1; 315/169.3; 345/98; 345/92; 345/211; 345/212; 324/750.3; 324/762.01; 324/762.02; 257/355; 257/357

(58) Field of Classification Search ..... 345/87, 345/92, 98, 100, 208, 211–213; 315/169.1–169.4, 315/291, 224; 324/750.3, 762.01, 762.02, 324/762.05, 762.06; 257/355–358; 365/226, 365/229, 230.06

See application file for complete search history.

(56) References Cited

U.S. PATENT DOCUMENTS 6,621,228 B2 * 9/2003 Harada et al. ..... 315/169.3
7,072,218 B2 * 7/2006 Fujito et al. ..... 365/185.18
7,187,373 B2 * 3/2007 Tobita ..... 345/211
7,227,523 B2 * 6/2007 Ishikawa et al. ..... 345/87

FOREIGN PATENT DOCUMENTS

JP 2005-331927 12/2005
JP 2007-94016 4/2007

* cited by examiner

*Primary Examiner* — Haiss Philogene
(74) *Attorney, Agent, or Firm* — McGinn IP Law Group, PLLC

(57) ABSTRACT

A driving circuit, which drives a display panel in a voltage range between a high negative voltage and a high positive voltage, includes: an electric charge discharging circuit; and a test external terminal. The electric charge discharging circuit connects a first terminal supplied with the high negative voltage to a second terminal of a ground voltage in response to a drop of a power source voltage. The test external terminal is connected to the electric charge discharging circuit. The high negative voltage is supplied to the semiconductor substrate. The electric charge discharging circuit interrupts a connection between the first terminal and the second terminal based on a control signal from the test external terminal.

12 Claims, 8 Drawing Sheets

DRIVING CIRCUIT FOR DISPLAY DEVICE, AND TEST CIRCUIT AND TEST METHOD FOR DRIVING CIRCUITS

INCORPORATED BY REFERENCE

This application is based upon and claims the benefit of priority from Japanese patent application No. 2008-098783 filed on Apr. 4, 2008, the disclosure of which is incorporated herein in its entirety by reference.

BACKGROUND OF THE INVENTION

1. Field of the Invention

The present invention relates to a driving circuit for a display device, and, a test circuit and a test method for the driving circuits. Specifically, the present invention relates to a driving circuit for a display device for driving a display panel in a voltage range between a high negative voltage and a high positive voltage, and a test circuit and test method for measuring the high negative voltage outputted from the driving circuits.

2. Description of Related Art

For a driving circuit (e.g., a liquid crystal display panel driving IC (Integrated Circuit)), which is used for a display device included in a portable electronic apparatus having a detachable battery, such as a cellular phone and a digital camera, there is a case where a power source voltage is interrupted or the power source voltage abruptly drops because of falling off of the buttery and the like.

FIG. 1 is a diagram showing one example of a conventional configuration of a liquid crystal display panel driver IC 200. The liquid crystal display panel driver IC 200 includes a source driver circuit 11, a gate driver circuit 12, a power source section 14 for the source driver circuit, a power source section 25 for the gate driver circuit, and an afterimage prevention circuit 23. The power source section 14 includes a charge pump circuit 140. The power source section 25 includes charge pump circuits 151 and 252. It is preferable that the liquid crystal display panel driver IC 200 includes the afterimage prevention circuit 23 in order that, when the interruption or the drop of the power source voltage occurs, an image displayed just before such incident may not remain. The afterimage prevention circuit 23 does not render an image displayed immediately before the sudden drop of the power source voltage in the liquid crystal display panel as an afterimage even at the case of the incident, so as to prevent burn-in on the screen and deterioration of a liquid crystal display panel 10.

Techniques related to the afterimage prevention circuit are described, for example, in Japanese Laid-Open Patent Application JP-P 2007-94016A (hereinafter referred to as the Patent Document 1) and JP-P 2005-331927A (hereinafter referred to as the Patent Document 2).

The liquid crystal display panel driver IC 200 includes a power source circuit which generates a driving signal voltage for driving the liquid crystal display panel 10. This power source circuit includes a power source section 25 for a gate driver circuit, which supplies high voltages (a high positive voltage VGH and a high negative voltage VGL) to a gate driver circuit 12 that needs the high voltages. Such a power source circuit needs to be constructed by a high-voltage process that can handle a high negative voltage in particular. For example, the high negative voltage is supplied as a substrate voltage to a charge pump circuit 252 generating a high negative voltage lower than the ground voltage GND.

The afterimage prevention circuit 23 includes an electric charge discharging circuit 230 as shown in FIG. 2. The electric charge discharging circuit 230 includes a switching circuit (e.g., an NMOS transistor MN10) connected between a power source terminal 2 of the ground voltage GND and a terminal 4 for supplying the high negative voltage VGL. The NMOS transistor MN10 controls a connection between the power source terminal 2 and the terminal 4 depending on a level of the control signal Vcon supplied into its gate. For example, when the power source voltage VDC indicates a normal value, the control signal Vcon of a low level is supplied, and the NMOS transistor MN10 becomes an OFF state to isolate the power source terminal 2 and the terminal 4. On the other hand, when the power source voltage VDC indicates an abnormal drop or is interrupted, the control signal Vcon of the high level is supplied, the NMOS transistor MN10 becomes an ON state to connect the power source terminal 2 to the terminal 4. By these operations, the voltage of the terminal 4 varies so as to converge to the ground voltage GND from the high negative voltage VGL, and a transistor (TFT: Thin Film Transistor) of each pixel in the liquid crystal display panel 10 becomes a half-conduction state, namely, a half-ON state. As a result, an impedance of the TFT of each pixel falls and electric charges accumulated in a liquid crystal capacity is discharged. Thereby the afterimage can be prevented.

The charge pump circuit 252 also includes the electric charge discharging circuit 230 as shown in FIG. 2. The charge pump circuit 252 changes its operational mode based on the supplied control signal Vcon. For example, it is turned to an OFF state (the output voltage is 0 V (the ground voltage GND)) in response to a high-level control signal Vcon, and is turned to an ON (operation) state (the output voltage is the high negative voltage VGL) in response to a low-level control signal Vcon. In detail, when the low level control signal Vcon is supplied, the NMOS transistor MN10 becomes the OFF state to isolate the power source terminal 2 and the terminal 4 (operation state). On the other hand, when the high-level control signal Vcon is supplied, the NMOS transistor MN10 becomes an ON state to connect the power source terminal 2 to the terminal 4 (OFF state). Thereby, the voltage of the terminal 4 changes so as to converge to the ground voltage GND from the high negative voltage VGL. Here, the electric charge discharging circuit 230 provided in the afterimage prevention circuit 23 and the electric charge discharging circuit 230 provided in the charge pump circuit 252 are different from each other.

Since the liquid crystal display panel driver IC 200 requires the power source section 25 for the gate driver circuit for outputting the high positive voltage VGH and the high negative voltage VGL, the circuit needs to be constructed by a high-voltage process, especially by a process that can handle the high negative voltage. Moreover, in the case where elements are isolated only by a PN junction isolation and a substrate of the IC chip is a P-type substrate, the substrate voltage must be a lowest voltage on the chip. In this case, the high negative voltage VGL is supplied as a substrate voltage of the liquid crystal display panel driver IC 200.

We have now discovered the following facts.

The markets of cellular phones, digital cameras and the like have been expanding, their prices have declined, and therefore the liquid crystal display panel driver IC is in a situation where cost reduction is needed as much as possible. Consequently, it is desired to reduce a test cost as well as reduction in chip sizes and manufacturing costs.

As a test method for reducing the test cost, there is a multi-measurement method in which a plurality of chips (e.g., a plurality of liquid crystal display panel drivers IC 200) is tested simultaneously. The multi-measurement method is a method that shortens a test time per chip to reduce the test cost by performing simultaneous probing on a plurality of chips on one wafer and making a test simultaneously or sequentially.

It becomes important to devise a circuit configuration that enables the test cost to be reduced also for the liquid crystal display panel driver IC 200, which includes addition functions such as the afterimage prevention circuit 23, and circuits such as a high negative power source (e.g., the charge pump circuit 252). At the same time, it becomes also important to perform a more stable test.

Here, a plurality of IC chips that is probed simultaneously is called DUT (Device Under Test). Since a substrate (not illustrated) of the each of the IC chips of the DUT is common as a wafer substrate, their electric potentials become equal to each other. Moreover, a minimum voltage in the IC chip (in the above-mentioned example, the high negative voltage VGL) must be supplied to the substrate (semiconductor substrate) of the IC chips produced on the wafer substrate of a P-type semiconductor. As a result, the VGL terminals (in the above-mentioned example, the terminals 4) of all the IC chips in the DUT will be electrically connected together to each other form the substrate of each IC chip via the wafer substrate.

An ground terminal (GND1) being set in an IC tester is connected to the ground terminal (GND) in each of the IC chips in the DUT. However, usually a switch or the like is not provided between the ground terminals (GND) of respective IC chips in the DUT in order to lower source impedance at the time of the test. Therefore, the ground terminals (GND) of all the IC chips of the DUT will be commonly connected to the ground voltage (GND).

Referring to FIG. 3, the conventional multi-measurement method for the liquid crystal display panel driver IC 200 will be explained in detail. Here, in this multi-measurement method, the two liquid crystal display panel driver ICs 200-1, 200-2 are tested as the DUT. Incidentally, a configuration of each of the liquid crystal display panel driver ICs 200-1, 200-2 is the same as that of the liquid crystal display panel driver IC 200 shown in FIG. 1.

In the liquid crystal display panel driver ICs 200-1, 200-2 in each of which the power source section 25 for the gate driver circuit is provided, the high negative voltage VGL is the substrate voltage for reasons of the process. The substrates (the terminals 4) of the liquid crystal display panel driver ICs 200-1, 200-2 in the DUT are electrically connected to each other via the wafer substrate. Consequently, upon measuring the high negative voltage VGL of each of the liquid crystal display panel driver ICs 200-1, 200-2, in order to eliminate mutual interference, not simultaneous measurement but sequential measurement must be performed also in the multi-measurement.

Here, the measurement of the high negative voltage VGL will be explained in the case where the electric charge discharging circuit 230 shown in FIG. 2 is mounted on the afterimage prevention circuit 23 of the liquid crystal display panel driver IC 200-1 (200-2). When the measurement of the high negative voltage VGL is performed on the liquid crystal display panel driver IC 200-1, the measurement is not performed on the liquid crystal display panel driver IC 200-2. At this time, neither the power source voltage VDC nor the power source voltage of the other system is supplied to the liquid crystal display panel driver IC 200-2. However, in the state where the power source voltage VDC is not supplied, since the high positive voltage VGH is equal to the ground voltage GND, the electric charge discharging circuit 230 operates when the high negative voltage VGL is supplied. At this time, the NMOS transistor MN10 in the electric charge discharging circuit 230 in the afterimage prevention circuit 23 becomes the ON state in response to interruption of the power source voltage VDC, and connects the power source terminal 2 to the terminal 4 in the liquid crystal display panel driver IC 200-2. Consequently, when neither the power source voltage VDC nor the power source voltage of the other system is supplied to the liquid crystal display panel driver IC 200-2, the built-in afterimage prevention circuit 23 (the electric charge discharging circuit 230) connects the power source terminal 2 to the terminal 4.

In this situation, when inspection and measurement of the liquid crystal display panel driver IC 200-1 are started, the high negative voltage VGL begins to drop and a negative voltage is generated by the charge pump circuit 252 of the liquid crystal display panel driver IC 200-1 being activated. At this time, the NMOS transistors MN10 in the electric charge discharging circuits 230 provided in the afterimage prevention circuit 23 and the charge pump circuit 252, respectively, are in the OFF state. However, the ground terminal 2 of the ground voltage GND and the terminal 4 supplied with the high negative voltage VGL are connected by the liquid crystal display panel driver IC 200-2. Therefore, as shown in FIG. 3, an overcurrent flows along a following path: the ground terminal 2, the NMOS transistor MN10 for discharging electric charges in the liquid crystal display panel driver IC 200-2, the substrate (the terminal 4) of the liquid crystal display panel driver IC 200-2, the wafer substrate common to the IC chips (the liquid crystal display panel driver ICs 200-1, 200-2), and the substrate (the terminal 4) of the liquid crystal display panel driver IC 200-1. This current is a load current that flows into the terminal 4 in the liquid crystal display panel driver IC 200-1. This phenomenon makes long a rise time of the high negative voltage VGL by the liquid crystal display panel driver IC 200-1 (a starting time of the liquid crystal display panel driver IC 200-1), and consequently a time until the inspection and measurement of the high negative voltage VGL becomes possible will be lengthened. As described above, if the multi-measurement is performed on the liquid crystal display panel driver IC on which the electric charge discharging circuit 230 is mounted, there will arise a trouble that the test time becomes long. Moreover, in the worst case, it could be possible that the latch-up or the like occur in the liquid crystal display panel driver IC 200-1 by the overcurrent from the liquid crystal display panel driver IC 200-2 which is not an object for the inspection and measurements which makes it impossible to perform the inspection and measurement.

The inspection and measurement of the high negative voltage VGL will be explained in the case where the electric charge discharging circuit 230 shown in FIG. 2 is mounted on the charge pump circuit 252 of the liquid crystal display panel driver ICs 200-1, 200-2. Similarly as described above, in the case where the inspection and the measurement are performed to the high negative voltage VGL of the liquid crystal display panel driver IC 200-1, supply of the power source voltage VDC etc. to the liquid crystal display panel driver IC 200-2 is interrupted. In this case, the control signal Vcon supplied into the electric charge discharging circuit 230 in the liquid crystal display panel driver IC 200-1 is an intermediate potential (an intermediate potential between about 0 V and the high negative voltage VGL). When the inspection (measurement) of the liquid crystal display panel driver IC 200-1 is started and the high negative voltage VGL falls, upon this event, the NMOS transistor MN10 becomes the ON state to connect the ground terminal 2 to the terminal 4. By this mechanism, the overcurrent flows into the terminal 4 of the liquid crystal display panel driver IC 200-1 via the same path as described above. Therefore, even in the case where the electric charge discharging circuit 230 is mounted on the charge pump 252 for generating the high negative voltage VGL, troubles, such as maximization of the test time or occurrence of latch-up, arise similarly as described above.

SUMMARY

The present invention seeks to solve one or more of the above problems, or to improve upon those problems at least in part. In one embodiment, a driving circuit, which drives a display panel in a voltage range between a high negative voltage and a high positive voltage, includes: an electric charge discharging circuit configured to connect a first terminal supplied with the high negative voltage to a second terminal of a ground voltage in response to a drop of a power source voltage; and a test external terminal configured to be connected to the electric charge discharging circuit, wherein the high negative voltage is supplied to the semiconductor substrate, wherein the electric charge discharging circuit interrupts a connection between the first terminal and the second terminal based on a control signal from the test external terminal.

In another embodiment, a test circuit includes: a device under test (DUT) configured to includes a plurality of driving circuits provided on one semiconductor substrate, wherein each of the plurality of driving circuits drives a display panel in a voltage range between a high negative voltage and a high positive voltage; and a tester configured to test the DUT, wherein each of the plurality of driving circuits includes: an electric charge discharging circuit configured to connect a first terminal supplied with the high negative voltage to a second terminal of a ground voltage in response to a drop of a power source voltage, and a test external terminal configured to be connected to the electric charge discharging circuit, wherein the high negative voltage is supplied to the one semiconductor substrate, wherein the electric charge discharging circuit interrupts a connection between the first terminal and the second terminal based on a control signal from the test external terminal, wherein a ground terminal of the tester is connected a ground terminal of the DUT, wherein the tester supplies the control signal to the test external terminal of an inspection-object driving circuit in the plurality of driving circuits, wherein the tester supplies another control signals to the test external terminals of the other driving circuits in the plurality of driving circuits.

In another embodiment, a test method for a plurality of driving circuits, wherein the plurality of driving circuits is provided on one semiconductor substrate and each of the plurality of driving circuits drives a display panel in a voltage range between a high negative voltage and a high positive voltage, the test method includes: interrupting supply of a power source voltage to a first driving circuit which one of the plurality of driving circuit; interrupting a connection between a first terminal supplied with the high negative voltage and a second terminal of a ground voltage in the first driving circuit; and measuring a high negative voltage of a second driving circuit which another of the plurality of driving circuit during the interruption of the connection between the first terminal and the second terminal in the first driving circuit.

Therefore, according to the present invention, a test time on the driving circuit for a display device that drives a display panel in a range between a high negative voltage and a high positive voltage can be shortened.

BRIEF DESCRIPTION OF THE DRAWINGS

The above and other objects, advantages and features of the present invention will be more apparent from the following description of certain preferred embodiments taken in conjunction with the accompanying drawings, in which.

DESCRIPTION OF THE PREFERRED EMBODIMENTS

Figure 1:
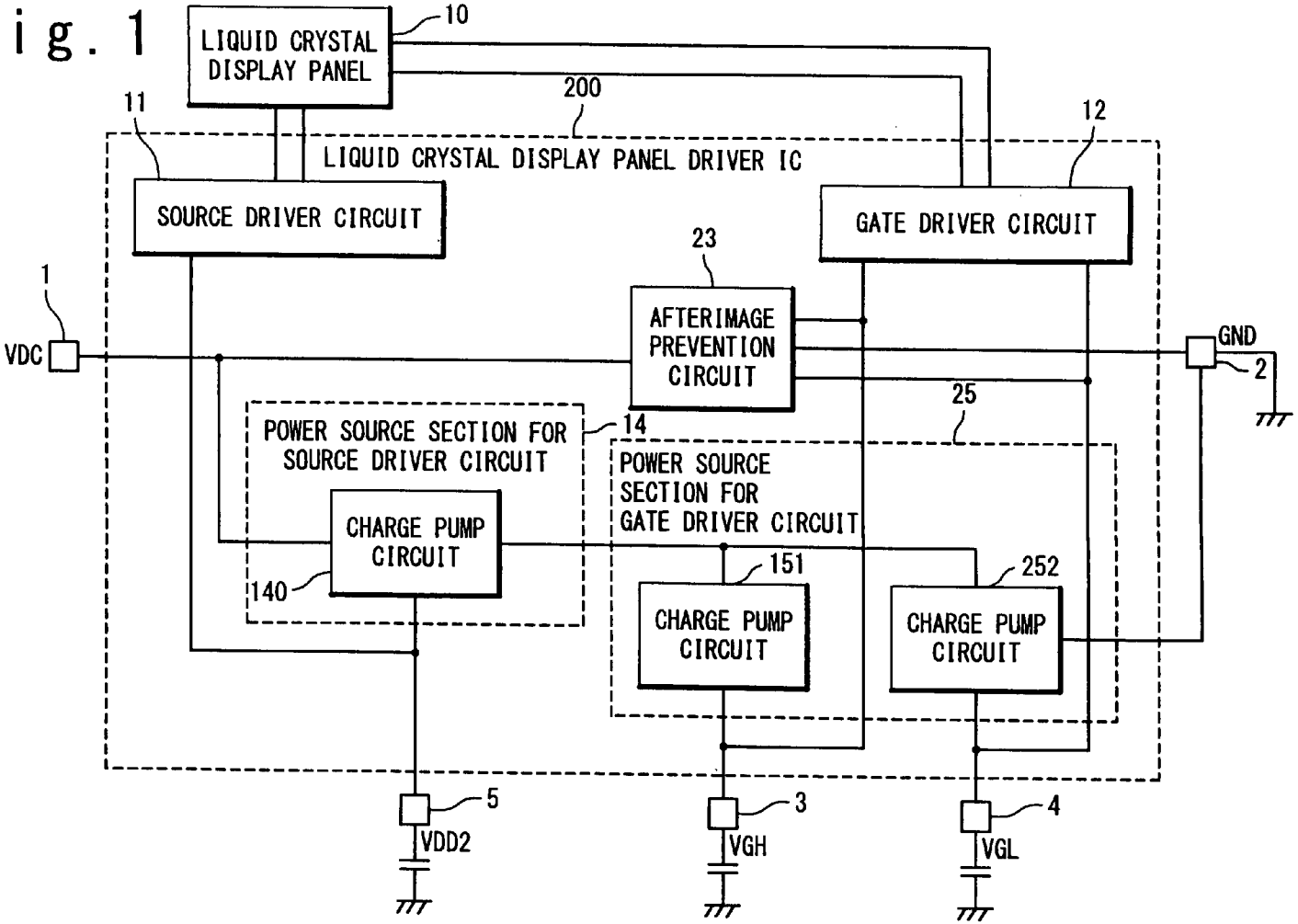
FIG. 1 is a block diagram showing a configuration of a liquid crystal display by a conventional technique.
Figure 2:
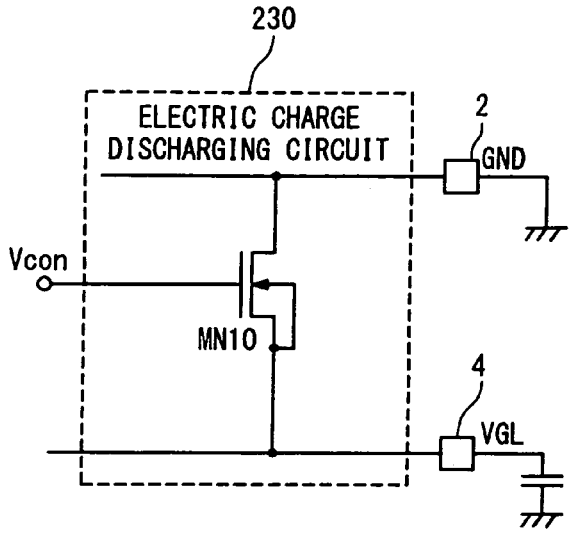
PRIOR ART Fig. 2
FIG. 2 is a circuit diagram showing a configuration of an electric charge discharging circuit by the conventional technique.

The invention will be now described herein with reference to illustrative embodiments. Those skilled in the art will recognize that many alternative embodiments can be accomplished using the teachings of the present invention and that the invention is not limited to the embodiments illustrated for explanatory purposed.

In the drawings, the same or similar reference numerals show the same, similar, or equivalent components. In the case where there is a plurality of same configurations, their reference numerals are added with additional serial numbers, and when an explanation is given generically without differentiating them, the explanation is given without adding the additional serial numbers.

1. Configuration of Liquid Crystal Display

Figure 4:
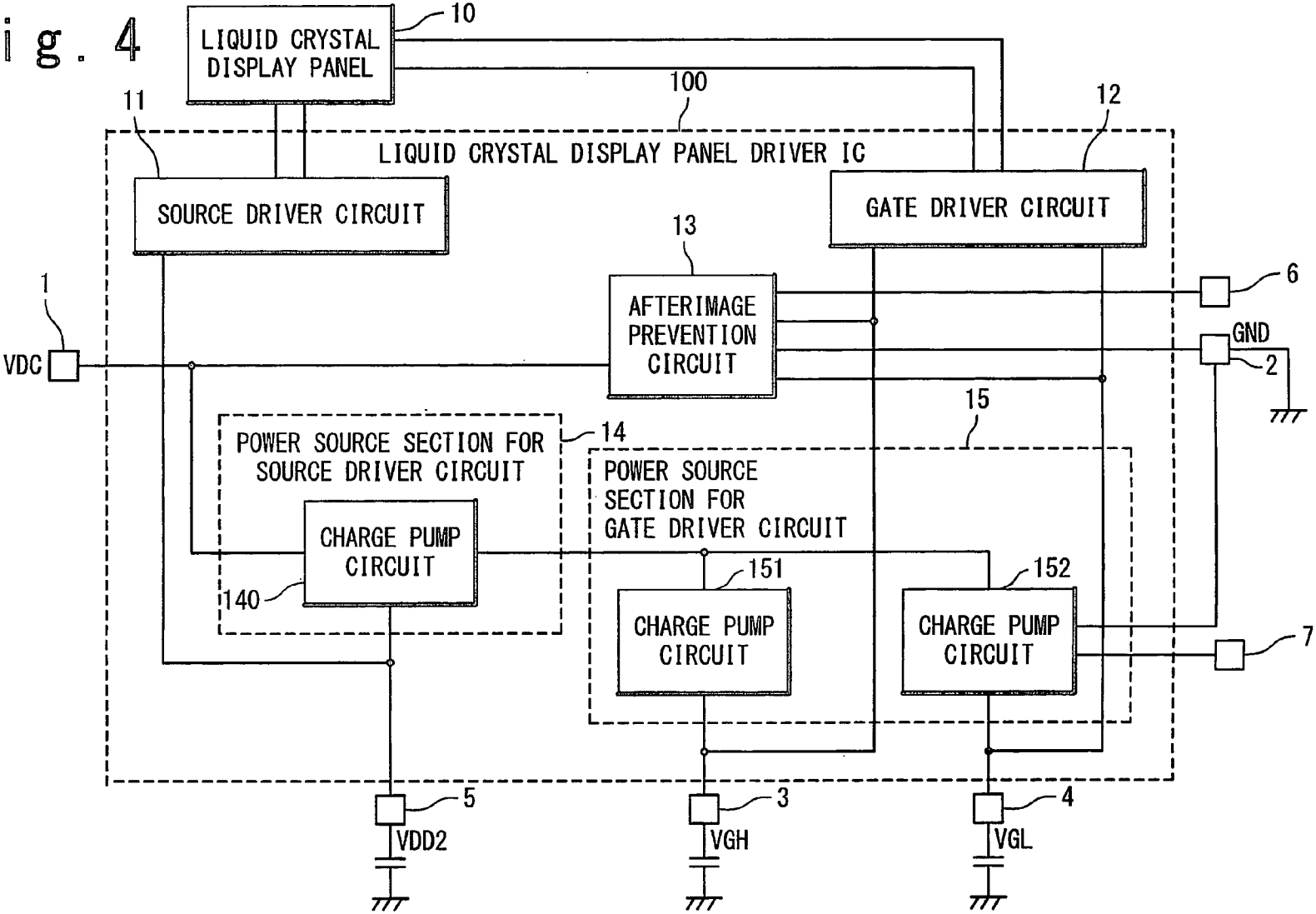
FIG. 4 is a block diagram showing a configuration of a liquid crystal display of an embodiment according to the present invention.

Referring to FIG. 4, a configuration of a liquid crystal display according to the present invention will be explained. The liquid crystal display according to the present invention includes a liquid crystal display panel 10 and a liquid crystal display panel driver IC 100. The liquid crystal display panel driver IC 100 includes a source driver circuit 11, a gate driver circuit 12, an afterimage prevention circuit 13, a power source section 14 for a source driver circuit, and a power source section 15 for a gate driver circuit.

The liquid crystal display panel 10 includes a plurality of pixels that is selectively activated by a source driving signal and a gate driving signal. The source driver circuit 11 outputs the source driving signal generated depending on a power source voltage VDD2 to a source of a transistor (TFT: Thin Film Transistor) of each pixel in the liquid crystal display panel 10. The gate driver circuit 12 outputs the gate driving signal generated depending on the power source voltages VGH, VGL to a gate of the TFT of each pixels in the liquid crystal display panel 10.

The power source section 14 for the source driver circuit includes a charge pump circuit 140. The charge pump circuit 140 generates the power source voltage VDD2 for the source driver circuit 11 from the power source voltage VDC of the system. The power source section 15 for the gate driver circuit includes a charge pump circuit 151 and a charge pump circuit 152. The charge pump circuit 151 generates the positive power source voltage VGH (hereinafter referred to as a high positive voltage VGH) for the gate driver circuit 12. The charge pump circuit 152 generates the negative power source voltage VGL (hereinafter referred to as a high negative voltage VGL) for the gate driver circuit 12. Here, the high positive voltage VGH is a higher voltage than the power source voltage VDC. The high negative voltage VGL is a lower voltage than the ground voltage GND (0 V). The power source circuit for generating such a source voltage needs to be constructed, especially, by a process that can handle the high negative voltage. For example, a substrate voltage of the charge pump circuit 152 for generating the high negative voltage VGL, which is a lower voltage than the ground voltage GND, must be set to the high negative voltage VGL.

Figure 5:
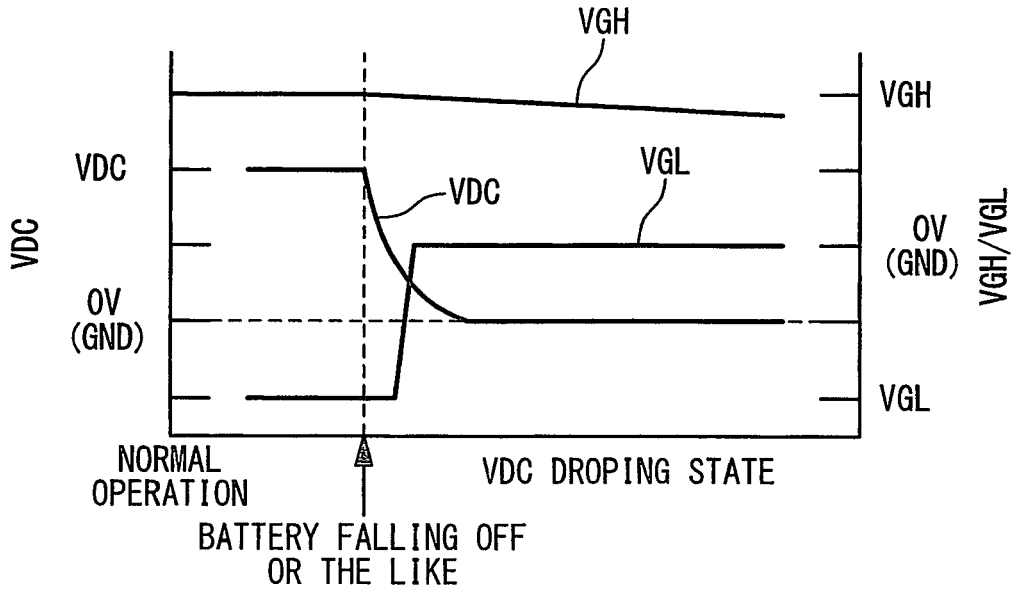
FIG. 5 is a signal waveform diagram showing an operation of an afterimage prevention circuit in the embodiment according to the present invention.

As shown in FIG. 5, when the afterimage prevention circuit 13 detects a change (a drop) of the power source voltage VDC supplied from a device power source, it connects the terminal 4 that is supplied with the high negative voltage VGL to the ground terminal 2 (ground voltage GND) to converge the high negative voltage VGL supplied to the gate driver circuit 12 to 0 V. Thus, even when the device power source drops its output suddenly, the afterimage prevention circuit 13 takes preventive measures so that an image rendered immediately before the drop may not remain on the liquid crystal panel 10, and thereby prevents burn-in and deterioration of the liquid crystal display panel 10.

2. Configuration and Operation of Afterimage Prevention Circuit

Figure 7:
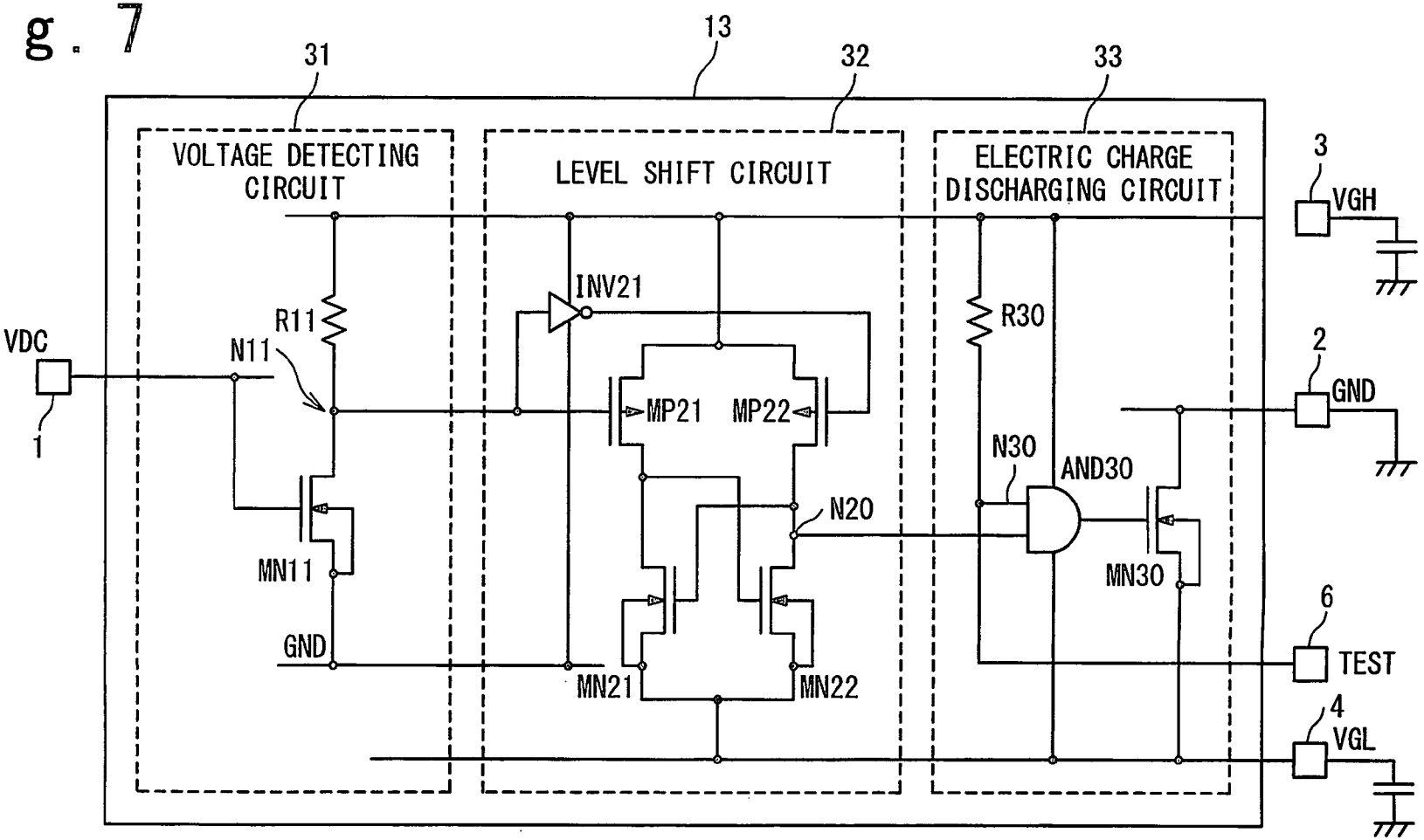
FIG. 7 is a circuit diagram showing a configuration of the afterimage prevention circuit in the embodiment according to the present invention.

Referring to FIGS. 5 and 7, the configuration and operation of the afterimage prevention circuit 13 according to the present invention in its embodiment will be explained in detail. Referring to FIG. 7, the afterimage prevention circuit 13 according to the present invention includes a voltage detecting circuit 31, a level shift circuit 32, and an electric charge discharging circuit 33.

The voltage detecting circuit 31 includes a resistor R11 and an NMOS transistor MN11. The resistor R11 and NMOS transistor MN11 are connected between a terminal 3 that is supplied with the high positive voltage VGH and the ground terminal 2. One end of the resistor R11 is connected to the terminal 3, and its other end is connected to a drain of the NMOS transistor MN11 via a node N11. A gate of the NMOS transistor MN11 is connected to the power source terminal 1 that is supplied with the power source voltage VDC, and its source is connected to the ground terminal 2. A resistance value of the resistor R11 is a sufficiently large value as compared with an ON resistance of the transistor MN11. By such a configuration, a voltage value of the node N11 is determined depending on a voltage level of the power source voltage VDC.

The level shift circuit 32 includes a level shifter (NMOS transistors MN21, MN22, PMOS transistors MP21, MP22, and an inverter INV21) for shifting the voltage of the node N11 into an appropriate drive voltage (a high positive voltage VGH level or a high negative voltage VGL level). Sources of the PMOS transistors MP21, MP22 are commonly connected to the terminal 3. A gate of the PMOS transistor MP21 is connected to the node N11, and its drain is connected to a gate of the NMOS transistor MN22 and a drain of the NMOS transistor MN21. A gate of the PMOS transistor MP22 is connected to the node N11 via the inverter INV21, and its drain is connected to a gate of the NMOS transistor MN21 and a drain of the NMOS transistor MN22 via an output node N20. Sources of the NMOS transistors MN21, MN22 are commonly connected to the terminal 4.

The electric charge discharging circuit 33 includes a pull-up resistor R30, an AND gate AND30, and a switching circuit. T pull-up resistor R30 is connected to an external terminal 6 for test. The AND gate AND30 operates in a voltage range between the high positive voltage VGH and the high negative voltage VGL. The switching circuit (the NMOS transistor MN30) controls a connection between the terminal 4 that is supplied with the high negative voltage VGL and the ground terminal 2 in response to an output of the AND gate AND30. One end of the pull-up resistor R30 is connected to the terminal 3 and its other end is connected to the external terminal 6 for test via a node N30. The AND gate AND30 receives an input signal from the node N30 connected to the external terminal 6 for test and another input signal from the output node N20, and outputs their logical product to a gate of an NMOS transistor MN30. The NMOS transistor MN30 is connected between the terminal 2 and the terminal 4, and connects the terminal 2 to the terminal 4 depending on a voltage level supplied into the gate. Here, since the NMOS transistor MN30 operates in a voltage range between the ground voltage GND and the high negative voltage VGL, the high negative voltage VGL is supplied to its substrate.

Next, an operation of the afterimage prevention circuit 13 will be explained. In a normal operation state, the external terminal 6 for test is set OPEN. In the normal operation state, the normal power source voltage VDC is supplied to the liquid crystal display panel driver IC 100. Consequently, the NMOS transistor MN11 of the voltage detecting circuit 31 turns ON, and the voltage of the node N11 becomes the ground voltage GND. When the node N11 is the ground voltage GND, the PMOS transistor MP21 and the NMOS transistor MN22 of the level shift circuit 32 turn ON, the NMOS transistor MN21 and the PMOS transistor MP22 thereof turn OFF, and the output node N20 turns into the high negative voltage VGL. In addition, since the external terminal 6 for test is OPEN, an input (the node N30) of the AND gate AND30 turns into the high positive voltage VGH by the pull-up resistor R30. Consequently, the output of the AND gate AND30 becomes a low level (the high negative voltage VGL). At this time, the NMOS transistor MN30 turns OFF and the high negative voltage VGL in the terminal 4 is maintained at a predetermined voltage.

Then, a case where the power source voltage VDC drops because of falling off of the butteries etc. (at the time of an abnormality in the power source voltage) will be explained. In this case, since the supply of the power source voltage VDC is interrupted or goes below a predetermined value, the charge pump circuits 140, 151, and 152 stop, but the high positive voltage VGH and the high negative voltage VGL exist as remaining electric charges in smoothing capacitors. When the power source voltage VDC goes below a threshold voltage of the NMOS transistor MN11, the NMOS transistor MN11 turns OFF and the voltage of the node N11 becomes the high positive voltage VGH. When the node N11 is at the high positive voltage VGH, the NMOS transistor MN21 and the PMOS transistor MN22 of the level shift circuit 32 turn ON, the PMOS transistor MP22 and the NMOS transistor MN22 thereof turn OFF, and the output node N20 turns into the high positive voltage VGH. Moreover, since the external terminal 6 for test is in an OPEN state, an input (the node N30) of the AND gate AND30 turns into the high positive voltage VGH by the pull-up resistor R30. Therefore, an output of the AND gate AND30 becomes a high level (the high positive voltage VGH). At this time, the NMOS transistor MN30 turns ON, the terminal 4 is connected to the ground terminal 2, and the high negative voltage VGL is converged to 0 V, as shown in FIG. 5. By this, the transistor (TFT) of each pixel becomes a half-conduction state, namely, a half-ON state, its impedance drops, and electric charges accumulated in a liquid crystal capacity are discharged. As described above, the afterimage prevention circuit 13 prevents the liquid crystal display panel from generating the afterimage at the time of abnormality in the power source voltage.

3. Multi-Measurement Method for Liquid Crystal Display Panel Driver IC 100 (Part 1)

Figure 8:
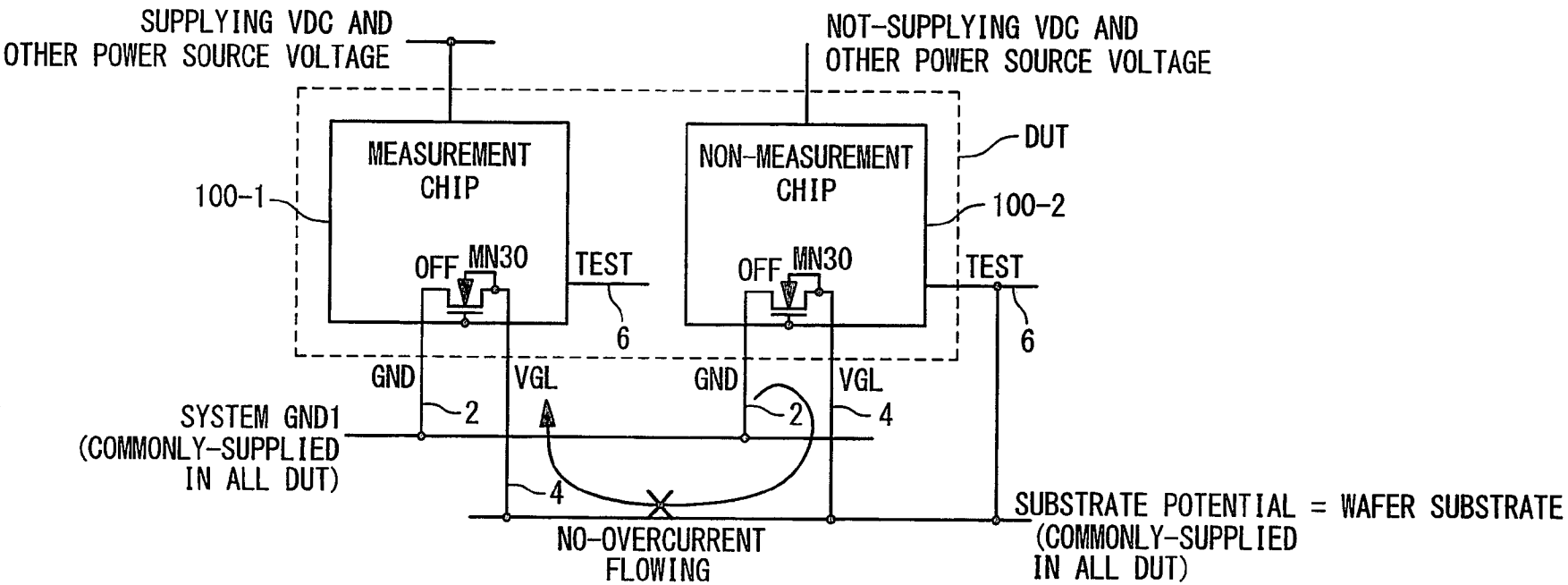
FIG. 8 is a diagram showing a configuration of a test circuit in the embodiment according to the present invention.

Referring to FIG. 8, a multi-measurement method on the liquid crystal display panel driver IC 100 according to the present invention will be explained. FIG. 8 is a conceptual diagram showing a configuration of a test circuit in an embodiment according to the present invention. Here, multi-measurement is performed on a plurality of liquid crystal display panel driver ICs 100 provided on the wafer substrate as the DUT. Here, the multi-measurement for testing the two liquid crystal display panel driver ICs 100-1, 100-2 as the DUT will be explained. A configuration of each of the liquid crystal display panel driver ICs 100-1, 100-2 is the same as that of the liquid crystal display panel driver IC 100 shown in FIG. 4.

As described above, in the case where the substrate voltage is a voltage that is different from the ground voltage GND (here, the high negative voltage VGL), the high negative voltage VGL of each of the liquid crystal display panel driver ICs 100-1, 100-2 is inspected (measured) sequentially. That is, when the inspection (measurement) of the high negative voltage VGL of the liquid crystal display panel driver IC 100-1 is carried out, the supply of the power source voltage VDC to the liquid crystal display panel driver IC 100-2 is interrupted, and an operation of the liquid crystal display panel driver IC 100-2 is stopped. Next, when the inspection (measurement) of the high negative voltage VGL of the liquid crystal display panel driver IC 100-2 is carried out, the supply of the power source voltage VDC to the liquid crystal display panel driver IC 100-1 is interrupted, and any operation of the liquid crystal display panel driver IC 100-1 is stopped. Naturally, the liquid crystal display panel driver IC 100 that is an object to be inspected (measured) is supplied with the power source voltage VDC. Here, a case where the liquid crystal display panel driver IC 100-1 is designated as an object to be inspected (measured) and the liquid crystal display panel driver IC 100-2 is designated as a standby system (non-measuring) on which the inspection (measurement) is not performed will be explained.

When the multi-measurement (sequential measurement) according to the present invention is performed, the external terminal 6 for test of the liquid crystal display panel driver IC 100-1 that is an object to be inspected (measured) is set OPEN. Since the power source voltage VDC is supplied to the liquid crystal display panel driver IC 100-1 and the external terminal 6 for test is set OPEN (open end), an operation of the liquid crystal display panel driver IC 100-1 becomes a normal operation state described above.

On the other hand, the external terminal 6 for test of the non-measuring liquid crystal display panel driver IC 100-2 is connected to the terminal 4 of the liquid crystal display panel driver IC 100-1 that is an object to be measured by a jig (probe card; not illustrated) that is used at the time of the test. That is, the external terminal 6 for test of the liquid crystal display panel driver IC 100-2 becomes the substrate voltage (here, the high negative voltage VGL). This high negative voltage VGL is considered to be a control signal to the external terminal 6. Consequently, a voltage of the input (node N30) of the AND gate in the electric charge discharging circuit 33 of the liquid crystal display panel driver IC 100-2 becomes the high negative voltage VGL (low level). Consequently, the output of the AND gate AND30 becomes the high negative voltage VGL (low level), the NMOS transistor MN30 turns OFF, and the terminal 4 of the liquid crystal display panel driver IC 100-2 is interrupted from the ground terminal 2.

Therefore, even when the charge pump circuit 152 of the liquid crystal display panel driver IC 100-1 is activated and the high negative voltage VGL begins to drop, an overcurrent like that of the conventional technique does not flow. That is, the liquid crystal display panel driver IC 100-1 becomes able to be inspected (measured) without being affected by the liquid crystal display panel driver IC 100-2.

Thereby, the high negative voltage VGL of the liquid crystal display panel driver IC 100-1 rises in normal time, and a test time is not lengthened. Moreover, since unlike the conventional technique it does not cause latch-up etc., normal inspection (measurement) can be performed. Further, not only because a requirement for a special function to an IC tester and a special program description become unnecessary, but also because the ground voltage (GND) being set in the IC tester can be used as the ground voltage GND of the DUT, stable inspection (measurement) becomes possible. As these results, it becomes possible to curtail the test cost by shortening the inspection (measurement) time and to improve yield by the stable inspection (measurement).

4. Configuration and Operation of Charge Pump Circuit 152

Figure 6:
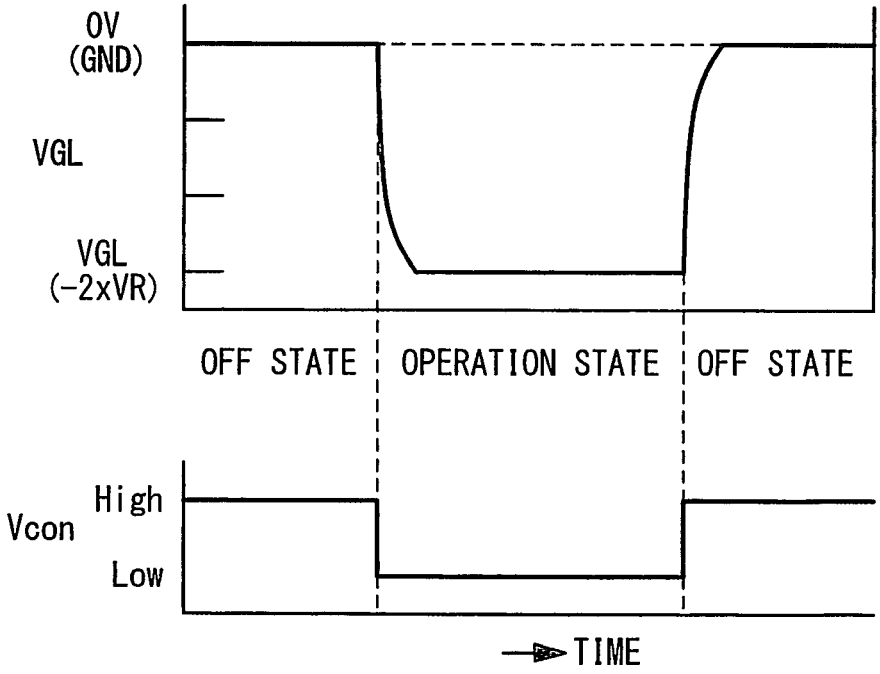
FIG. 6 is a signal waveform diagram showing an operation of a charge pump circuit in the embodiment according to the present invention.
Figure 9:
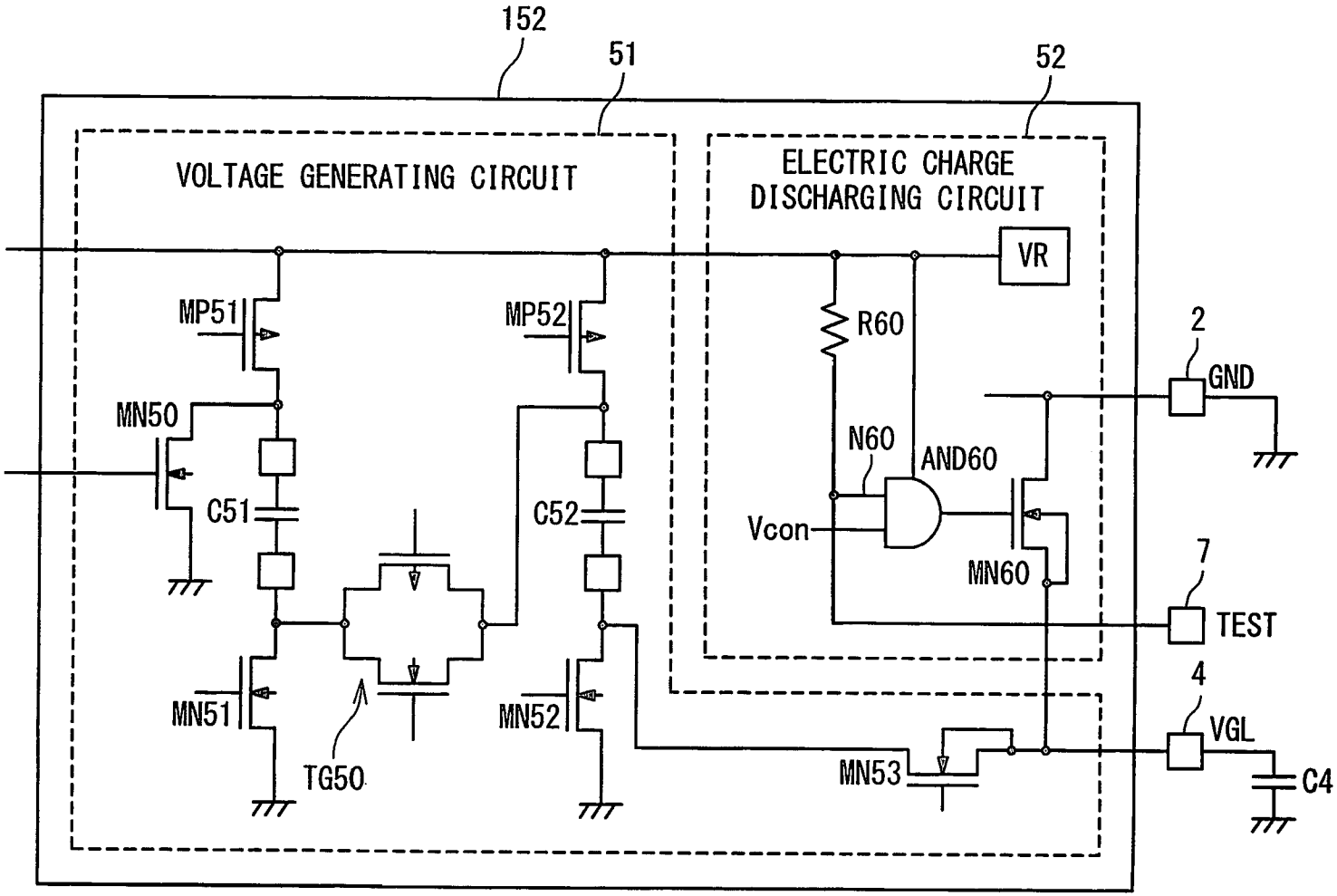
FIG. 9 is a circuit diagram showing a configuration of the charge pump circuit in the embodiment according to the present invention.

Referring to FIGS. 6 and 9, a configuration and an operation of the charge pump circuit 152 in its embodiment according to the present invention will be explained in detail. Here, a −2×VR charge pump circuit for generating the high negative voltage VGL that is a negative power source for a gate driver circuit will be explained as one example. The VR is a source-side line voltage of PMOS transistors MP51, MP52 that will be described later. As shown in FIG. 9, the charge pump circuit 152 according to the present invention includes a voltage generating circuit 51 and an electric charge discharging circuit 52.

The voltage generating circuit 51 includes capacitors C51, C52, a transfer gate TG50, NMOS transistors MN50, MN51, MN52, and MN53, the PMOS transistors MP51, MP52. A positive-side terminal of the capacitor C51 is connected to a line VR that is supplied with a voltage VR via the PMOS transistor MP51, and a negative-side terminal thereof is connected to the ground terminal 2 via the NMOS transistor MN51. In addition, the positive-side terminal of the capacitor C51 is connected to the ground terminal 2 via the NMOS transistor MN50. A positive-side terminal of the capacitor C52 is connected to the line VR that is supplied with the voltage VR via the PMOS transistor MP52, and a negative-side terminal thereof is connected to the ground terminal 2 via the NMOS transistor MN52. In addition, the negative-side terminal of the capacitor C52 is connected to the terminal 4 via the NMOS transistor MN53. The negative-side terminal of the capacitor C51 is connected to the positive-side terminal of the capacitor C52 via the transfer gate TG50.

The capacitors C51, C52 are charged with the voltage VR in a charging operation period. The NMOS transistors MN51, MN52 and the PMOS transistors MP51, MP52 function as the switching circuits. That is, in the charging operation period, the PMOS transistor MP51 and the NMOS transistor MN51 connect the capacitor C51 to the line (VR) that is supplied with the voltage VR and the ground terminal 2 (GND), respectively. Similarly, in the charging operation period, the PMOS transistors MP52 and the NMOS transistors MN52 connect the capacitor C52 to the line (VR) and the ground terminal 2 (GND), respectively. In the discharging operation period, the PMOS transistor MP51 and the NMOS transistor MN51 disconnect the capacitor C51 to the line (VR) and the ground terminal 2 (GND), respectively. Similarly, in the discharging operation period, the PMOS transistor MP52 and the NMOS transistor MN52 disconnect the capacitor C52 to the line (VR) and the ground terminal 2 (GND), respectively. The NMOS transistor MN50 functions as a switching circuit, and connects the positive-side terminal of the capacitor C51 and the ground terminal 2 in the discharging operation period. Similarly, the NMOS transistor MN53 functions as a switching circuit, and connects the negative-side terminal of the capacitor C52 and the terminal 4 in the discharging operation period. The transfer gate TG50 disconnects the negative-side terminal of the capacitor C51 to the positive-side terminal of the capacitor C52 in the charging operation period, and connects the negative-side terminal of the capacitor C51 to the positive-side terminal of the capacitor C52 in the discharging operation period.

The electric charge discharging circuit 52 includes the pull-up resistor R60, an AND gate AND60, the switching circuit (the NMOS transistor MN60). The pull-up resistor R60 is connected to an external terminal 7 for test. The switching circuit (the NMOS transistor MN60) controls a connection between the terminal 4 that is supplied with the high negative voltage VGL and the ground terminal 2 in response to the output of the AND gate AND60. One end of the pull-up resistor R60 is connected to the line VR, and its other end is connected to the external terminal 7 for test via a node N60. The AND gate AND60 receives the signal from the node N60 connected to the external terminal 7 for test and the control signal Vcon as inputs, and outputs their logical product to the gate of the NMOS transistor MN60. The NMOS transistor MN60 is connected between the terminal 2 and the terminal 4, and connects the terminal 2 to the terminal 4 depending on the voltage level supplied into the gate. Here, since the NMOS transistor MN60 operates between the ground voltage GND and the high negative voltage VGL, the high negative voltage VGL is supplied to its substrate.

Next, an operation of the charge pump circuit 152 will be explained. The external terminal 7 for test is set OPEN in a normal operation state. Referring to FIG. 6, when the charge pump circuit 152 is in an operation stop state (OFF state), the high-level control signal Vcon is supplied; when being in an operating state, the low level control signal Vcon is supplied. In the OFF state, the control signal Vcon becomes a high level and the node N60 becomes a high level by the pull-up resistor R60. Because of this, the output of the AND gate AND60 becomes a high level, the NMOS transistor MN60 turns ON, and the terminal 4 is connected to the ground terminal 2. In addition, since the charge pump operation clock has stopped at this time, the NMOS transistor MN53 turns OFF and the high negative voltage VGL becomes 0 V.

When the charge pump circuit 152 shifts to an operating state, the control signal Vcon becomes a low level, a charge pump clock is supplied thereto, and the charge pump circuit 152 repeats a charging period (the PMOS transistors MP51, MP52 and the NMOS transistors MN51, MN52 are ON, and the NMOS transistors MN50, MN53 and the transfer gate TG50 are OFF) and a discharging period (the PMOS transistors MP51, MP52 and the NMOS transistors MN51, MN52 are OFF, and the NMOS transistors MN50, MN53, and the transfer gate TG50 are ON). In the charging period, the capacitors C51, C52 are charged by the VR. In the discharging period, the electric charges charged in the capacitors C51, C52 are added and the positive-side terminal of the capacitor C51 is connected to the ground terminal 2. As a result, a smoothing capacitor C4 is charged to the voltage −2×VR to generate the high negative voltage VGL.

5. Multi-Measurement Method for Liquid Crystal Display Panel Driver IC 100 (Part 2)

Referring to FIG. 8, the multi-measurement method according to the present invention for the liquid crystal display panel driver IC 100 will be explained. Here, the multi-measurement for testing the two liquid crystal display panel driver ICs 100-1, 100-2 as the DUT will be explained. A configuration of each of the liquid crystal display panel driver ICs 100-1, 100-2 is the same as that of the liquid crystal display panel driver IC 100 shown in FIG. 4. Here, an explanation will be given while the external terminal 6 for test and the NMOS transistor MN30 that are shown in FIG. 8 are read as the external terminal 7 for test and the NMOS transistor 60, respectively.

When the multi-measurement (sequential measurement) according to the present invention is performed, the external terminal 7 for test of the liquid crystal display panel driver IC 100-1 that is an object to be inspected (measured) is set OPEN. Since the liquid crystal display panel driver IC 100-1 is supplied with the power source voltage VDC and the external terminal 7 for test is being set OPEN, the liquid crystal display panel driver IC 100-1 becomes an operating state, as described above.

On the other hand, the external terminal 7 for test of the non-measuring liquid crystal display panel driver IC 100-2 is connected to the terminal 4 of the liquid crystal display panel driver IC 100-1 that is an object to be measured by a jig (a probe card; not illustrated) used at the time of the test. Consequently, the input (node N60) of the AND gate AND60 in the electric charge discharging circuit 52 of the liquid crystal display panel driver IC 100-2 turns into the high negative voltage VGL (low level). This high negative voltage VGL is considered to be a control signal to the external terminal 7. Consequently, the output of the AND gate AND60 turns into the high negative voltage VGL (low level), the NMOS transistor MN60 turns OFF, and the terminal 4 of the liquid crystal display panel driver IC 100-2 is interrupted from the ground terminal 2.

Therefore, even when the charge pump circuit 152 of the liquid crystal display panel driver IC 100-1 is activated and the high negative voltage VGL begins to drop, an overcurrent like that of the conventional technique does not flow. That is, the liquid crystal display panel driver IC 100-1 becomes able to be inspected (measured) without being affected by the liquid crystal display panel driver IC 100-2.

Thereby, the high negative voltage VGL of the liquid crystal display panel driver IC 100-1 rises in normal time, and the test time is not lengthened. In addition, since unlike the conventional technique it does not cause latch-up etc., the normal inspection (measurement) can be performed. Further, not only because a requirement for a special function to the IC tester and a special program description become unnecessary, but also because the ground voltage (GND1) being set in the IC tester can be used as the ground voltage GND of the DUT; the stable inspection (measurement) becomes possible. From these results, it becomes possible to curtail a test cost by shortening the inspection (measurement) time, and to improve the yield by the stable inspection (measurement).

As described above, in the present invention, the control signal (e.g., the high negative voltage VGL) from the external terminal (the external terminal for test) is supplied into the electric charge discharging circuit of the afterimage prevention circuit or the charge pump circuit for generating the high-voltage negative power source. Thereby, by controlling the external terminal for test on the non-measuring chip at the time of the multi-measurement, even in a state where a system power source, such as the power source voltage VDC, is not supplied to the non-measuring chip, it becomes possible to make the terminal 4 that is supplied with the high negative voltage VGL of the non-measuring chip not be connected to the ground terminal 2 (ground voltage GND).

That is, according to the test circuit in the present invention, by preventing generation of the overcurrent within the non-measuring chip by the operation of the measuring chip, the starting time for the high negative voltage VGL in the measuring chip can be reduced, and the test time can be decreased.

Figure 3:
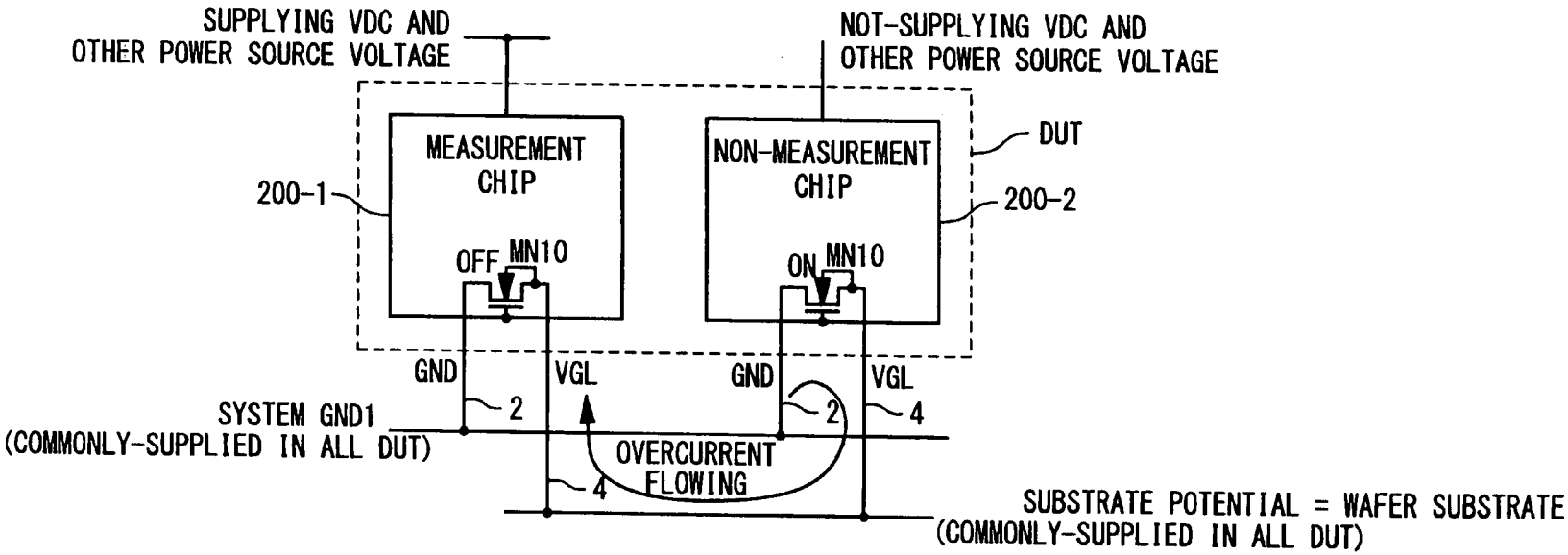
Fig. 3 PRIOR ART
FIG. 3 is a conceptual diagram explaining a multi-measurement method by the conventional technique.

In the test circuit of the conventional technique shown in FIG. 3, in order to avoid the generation of an overcurrent that flows thereinto from a liquid crystal display panel driver IC 200-2 on which the inspection (measurement) is not performed, a following method is conceivable. That is, the generation of the overcurrent is avoided by supplying the power source voltage VDC or the like also to the liquid crystal display panel driver IC 200-2. However, in this case, it is necessary to add a special function and a program description to the IC tester. Alternatively, a method for avoiding the generation of the overcurrent is conceivable where the ground terminal (ground voltage GND) of each IC is isolated on a chip basis, and 0 V is supplied from the IC tester only to the ground terminal 2 of the liquid crystal display panel driver IC 200-1 on which the inspection (measurement) is to be performed. However, there arises a problem that the stable inspection (measurement) cannot be performed because an impedance to the ground terminal 2 of the liquid crystal display panel driver IC 200-1 cannot be sufficiently lowered.

In the case where the inspection (measurement) of the liquid crystal display panel driver IC 100 according to the present invention is performed with the test circuit of the configuration shown in FIG. 8, controlling supply of the power source to the liquid crystal display panel driver IC 200-2 that is not inspected (measured) can be performed as usual. Therefore, neither a special function nor a special program description needs to be added to the IC tester. Moreover, since a system ground voltage (GND1) of the IC tester can be used as the ground voltage GND of the DUT, impedance to the ground terminal 2 can sufficiently be lowered, and the stable inspection (measurement) becomes possible. From these results, it becomes possible to curtail the test cost by shortening the inspection (measurement) time, and to improve the yield by the stable inspection (measurement).

In the above, the embodiments of the present invention have been explained in detail. However, specific configurations are not restricted to the above-mentioned embodiments, and even if there is alteration without departing from the scope and spirit of the invention, it will be included in the present invention. For example, the AND gate provided in the electric charge discharging circuits 33, 52 may be replaced by other logic operational circuits.

That is, although the present invention has been described above in connection with several exemplary embodiments thereof, it would be apparent to those skilled in the art that those exemplary embodiments are provided solely for illustrating the present invention, and should not be relied upon to construe the appended claims in a limiting sense.

What is claimed is:

1. A driving circuit, which drives a display panel in a voltage range between a high negative voltage and a high positive voltage, comprising:

an electric charge discharging circuit configured to connect a first terminal supplied with said high negative voltage to a second terminal of a ground voltage in response to a drop of a power source voltage; and a test external terminal configured to be connected to said electric charge discharging circuit, wherein said high negative voltage is supplied to a semiconductor substrate, wherein said electric charge discharging circuit interrupts a connection between said first terminal and said second terminal based on a control signal from said test external terminal.

2. The driving circuit according to claim 1, wherein said electric charge discharging circuit includes:

a logic circuit configured to be connected to said test external terminal and a node whose voltage is changed in response to said drop of said power course voltage, wherein said logic circuit receives said control signal from said test external terminal and said voltage of said node as inputs, and outputs a logic operation result, and a switch circuit configured to control said connection between said first terminal and said second terminal in response to said logic operation result.

3. The driving circuit according to claim 2, further comprising:

an afterimage prevention circuit configured to suppress an afterimage in said display panel, wherein said afterimage prevention circuit includes:

a voltage detecting circuit configured to detect a change of said power source voltage, a level shift circuit configured to shift said detected change of said power source voltage into a predetermined voltage, and change said voltage of said node into said shifted predetermined voltage, and said electric charge discharging circuit, which is connected to said level shift circuit.

4. The driving circuit according to claim 2, further comprising:

a charge pump circuit configured to generate said high negative voltage based on said power source voltage, wherein said charge pump circuit includes:

a voltage generating circuit configured to generate said high negative voltage based on said power source voltage, and said electric charge discharging circuit, which is connected to said voltage generating circuit, and receive a control voltage as said voltage of said node.

5. The driving circuit according to claim 2, wherein said driving circuit is included in a plurality of driving circuits provided on said semiconductor substrate, each of said plurality of driving circuits has a same structure.

6. A test circuit comprising:

a device under test (DUT) configured to include a plurality of driving circuits provided on one semiconductor substrate, wherein each of said plurality of driving circuits drives a display panel in a voltage range between a high negative voltage and a high positive voltage; and a tester configured to test said DUT, wherein each of said plurality of driving circuits includes:

an electric charge discharging circuit configured to connect a first terminal supplied with said high negative voltage to a second terminal of a ground voltage in response to a drop of a power source voltage, and a test external terminal configured to be connected to said electric charge discharging circuit, wherein said high negative voltage is supplied to said one semiconductor substrate, wherein said electric charge discharging circuit interrupts a connection between said first terminal and said second terminal based on a control signal from said test external terminal, wherein a ground terminal of said tester is connected a ground terminal of said DUT, wherein said tester supplies said control signal to said test external terminal of an inspection-object driving circuit in said plurality of driving circuits, wherein said tester supplies another control signal to said test external terminals of the other driving circuits in said plurality of driving circuits.

7. The test circuit according to claim 6, wherein said electric charge discharging circuit includes:

a logic circuit configured to be connected to said test external terminal and a node whose voltage is changed in response to said drop of said power course voltage, wherein said logic circuit receives said control signal from said test external terminal and said voltage of said node as inputs, and outputs a logic operation result, and a switch circuit configured to control said connection between said first terminal and said second terminal in response to said logic operation result.

8. The test circuit according to claim 7, wherein said driving circuit further includes:

an afterimage prevention circuit configured to suppress an afterimage in said display panel, wherein said afterimage prevention circuit includes:

a voltage detecting circuit configured to detect a change of said power source voltage, a level shift circuit configured to shift said detected change of said power source voltage into a predetermined voltage, and change said voltage of said node into said shifted predetermined voltage, and said electric charge discharging circuit, which is connected to said level shift circuit.

9. The test circuit according to claim 7, wherein said driving circuit further includes:

a charge pump circuit configured to generate said high negative voltage based on said power source voltage, wherein said charge pump circuit includes:

a voltage generating circuit configured to generate said high negative voltage based on said power source voltage, and said electric charge discharging circuit, which is connected to said voltage generating circuit, and receive a control voltage as said voltage of said node.

10. The test circuit according to claim 6, wherein said test external terminal of said inspection-object driving circuit is set to an open terminal, and wherein said test external terminals of the other driving circuits are connected to a substrate of said DUT through said one semiconductor substrate.

11. A test method for a plurality of driving circuits, wherein said plurality of driving circuits is provided on one semiconductor substrate and each of said plurality of driving circuits drives a display panel in a voltage range between a high negative voltage and a high positive voltage, said test method comprising:

interrupting supply of a power source voltage to a first driving circuit which is one of said plurality of driving circuits;

interrupting a connection between a first terminal supplied with said high negative voltage and a second terminal of a ground voltage in said first driving circuit; and measuring a high negative voltage of a second driving circuit which is another of said plurality of driving circuits during said interruption of said connection between said first terminal and said second terminal in said first driving circuit.

12. The test method according to claim 11, wherein each of said plurality of driving circuits includes:

an electric charge discharging circuit configured to connect said first terminal to said second terminal, and a test external terminal configured to be connected to said electric charge discharging circuit, wherein said high negative voltage is supplied to said one semiconductor substrate, wherein said step of said interrupting said connection, includes:

said electric charge discharging circuit in said first driving circuit interrupting said connection between said first terminal and said second terminal based on a control signal from said test external terminal.

* * * * *